US009401563B2

(12) United States Patent
Simpson et al.

(10) Patent No.: US 9,401,563 B2
(45) Date of Patent: Jul. 26, 2016

(54) CABLE HEADER CONNECTOR

(71) Applicant: Tyco Electronics Corporation, Berwyn, PA (US)

(72) Inventors: Jeffrey Stewart Simpson, Mechanicsburg, PA (US); Julia Anne Lachman, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 148 days.

(21) Appl. No.: 14/157,164

(22) Filed: Jan. 16, 2014

(65) Prior Publication Data

US 2015/0200496 A1 Jul. 16, 2015

(51) Int. Cl.

| | |
|---|---|
| ***H01R 13/648*** | (2006.01) |
| ***H01R 13/58*** | (2006.01) |
| *H01R 13/6471* | (2011.01) |
| *H01R 13/6585* | (2011.01) |

(52) U.S. Cl.

CPC ..... *H01R 13/5841* (2013.01); *H01R 13/6471* (2013.01); *H01R 13/6585* (2013.01)

(58) Field of Classification Search

CPC ..... H01R 23/688; H01R 23/005; H01R 23/7073; H01R 13/65807; H01R 13/658; H01R 13/65802; H01R 13/5808

USPC ..... 439/607.08, 607.41, 701, 456, 468

See application file for complete search history.

(56) References Cited

U.S. PATENT DOCUMENTS

| | | | | | |
|---|---|---|---|---|---|
| 3,920,306 | A * | 11/1975 | Barnett et al. | ..... | 439/459 |
| 5,009,616 | A * | 4/1991 | Fogg et al. | ..... | 439/607.1 |
| 5,731,546 | A * | 3/1998 | Miles et al. | ..... | 174/135 |
| 6,225,557 | B1 * | 5/2001 | Fonteneau et al. | ..... | 174/50 |
| 6,551,125 | B2 * | 4/2003 | Ikeda et al. | ..... | 439/456 |
| 7,029,314 | B2 * | 4/2006 | Muro et al. | ..... | 439/404 |
| 8,449,330 | B1 * | 5/2013 | Schroll et al. | ..... | 439/607.06 |

* cited by examiner

*Primary Examiner* — Hien Vu

(57) ABSTRACT

A cable header connector includes a contact module having a support body and a plurality of cable assemblies held by the support body and arranged in a column. The cable assemblies each have a contact terminated to a cable and a ground shield coupled to and providing electrical shielding for the contact sub-assembly. The support body has contact channels extending along respective contact channel axes which are parallel to each other, and at least one cable channel intersecting the contact channels. The cables extend through the contact channels and through the at least one cable channel to an outside of the support body. The cables emerging from the support body at corresponding cable exits at respective angles to the contact channel axes.

16 Claims, 7 Drawing Sheets

CABLE HEADER CONNECTOR

BACKGROUND OF THE INVENTION

The subject matter herein relates generally to cable header connectors.

High speed differential connectors are known and used in electrical systems, such as communication systems to transmit signals within a network. Some electrical systems utilize cable mounted electrical connectors to interconnect the various components of the system. Routing of the cables is difficult, particularly in high density applications having many connectors and many cables. Some systems have space constraints at the cable exit, which limit the distance that the cables can extend behind the connectors. The cables need to be bent, typically perpendicular to the cable exit. If the cables are bent too sharply, the cables may be damaged.

A need remains for a cable connector that controls the bending and exit of the cables from the connector.

BRIEF DESCRIPTION OF THE INVENTION

In one embodiment, a cable header connector is provided that includes a contact module having a support body and a plurality of cable assemblies held by the support body and arranged in a column. The cable assemblies each have a contact terminated to a cable and a ground shield coupled to and providing electrical shielding for the contact sub-assembly. The support body has contact channels extending along respective contact channel axes which are parallel to each other, and at least one cable channel intersecting the contact channels. The cables extend through the contact channels and through the at least one cable channel to an outside of the support body. The cables emerging from the support body at corresponding cable exits at respective angles to the contact channel axes.

In another embodiment, a cable header connector is provided including a header housing having a base wall with support walls extend rearward from the base wall to define a module cavity behind the base wall, with the support walls being arranged along a top and a bottom of the module cavity. Contact modules are received in the module cavity. Each contact module has a support body and a plurality of cable assemblies held by the support body and arranged in a column. The cable assemblies each have a contact sub-assembly terminated to a cable and a ground shield coupled to and providing electrical shielding for the contact sub-assembly. The support body has a top and a bottom opposite the top with the top extending along the support wall at the top of the module cavity and the bottom extending along the support wall at the bottom of the module cavity. The support body has contact channels extending along contact channel axes that receive portions of the contact sub-assemblies and portions of the cables. The support body has cable channels receiving portions of the cables from the contact channels. The cables are routed in the cable channels from the contact channels to cable exits at the top and/or the bottom of the support body.

DETAILED DESCRIPTION OF THE INVENTION

Figure 1:
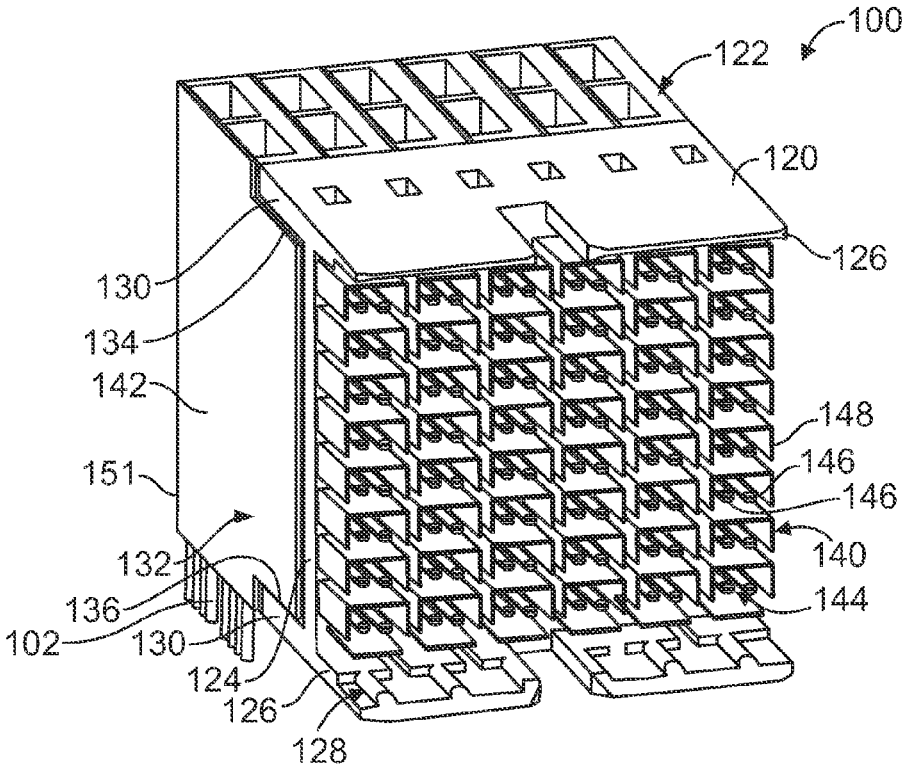
FIG. 1 is a front, top perspective view of a cable header connector formed in accordance with an exemplary embodiment.
Figure 2:
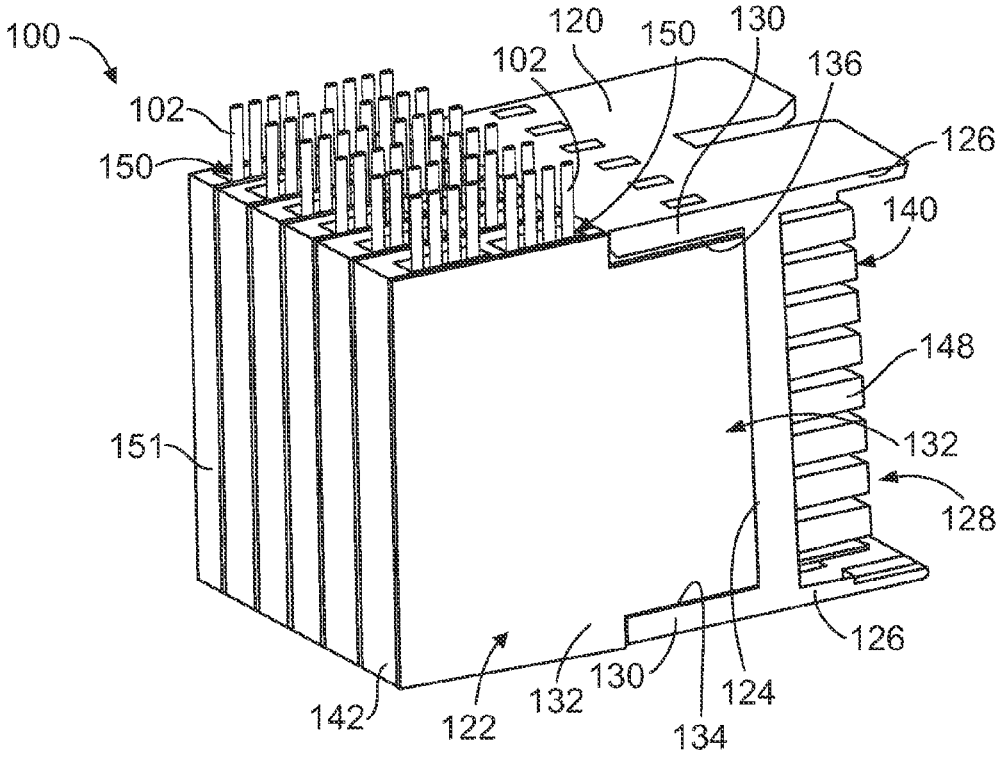
FIG. 2 is a rear, bottom perspective of the cable header connector shown in FIG. 1.

FIG. 1 is a front, top perspective view of a cable header connector 100 formed in accordance with an exemplary embodiment. FIG. 2 is a rear, bottom perspective of the cable header connector 100. The cable header connector 100 is configured to be mated with a receptacle connector (not shown). The receptacle connector may be board mounted to a printed circuit board or terminated to one or more cables, for example. The cable header connector 100 is a high speed differential pair cable connector that includes a plurality of differential pairs of conductors arrayed for mating at a common mating interface. The differential conductors are shielded along the signal paths thereof to reduce noise, crosstalk and other interference along the signal paths of the differential pairs.

A plurality of cables 102 extend from the cable header connector 100. In an exemplary embodiment, the cable header connector 100 directs the cables 102 in predetermined directions, such as above the cable header connector 100, below the cable header connector 100 or in some embodiments, both above and below the cable header connector 100.

In an exemplary embodiment, the cables 102 are twin axial cables having two signal wires within a common jacket of the cable 102. In an exemplary embodiment, the signal wires are individually shielded, such as with a cable braid. The cable braids define grounded elements of the cable 102. A drain wire may be provided within the jacket of the cable 102. The drain wire may be electrically connected to the shielding of the signal wires. The drain wire defines a grounded element of the cable 102. Optionally, the cable 102 may include cable braids surrounding the signal wires that define grounded elements. The signal wires convey differential signals. The grounded elements of the cable 102 provide shielding for the signal wires into the cable header connector 100. Other types of cables 102 may be provided in alternative embodiments. For example, coaxial cables may extend from the cable header connector 100 carrying a single signal conductor therein.

The cable header connector 100 includes a header housing 120 holding a plurality of contact modules 122. The header housing 120 includes a base wall 124. The contact modules 122 are coupled to the base wall 124. In the illustrated embodiment, the header housing 120 includes shroud walls 126 extending forward from the base wall 124 to define a mating cavity 128 of the cable header connector 100. The shroud walls 126 guide mating of the cable header connector 100 with the receptacle connector during mating thereto. In the illustrated embodiment, the header housing 120 has support walls 130 extending rearward from the base wall 124.

The contact modules 122 are coupled to the support walls 130. The support walls 130 may include features to guide the contact modules 122 into position with respect to the header housing 120 during mating of the contact modules 122 to the header housing 120. The support walls 130 define a module cavity 132 that receives at least portions of the contact modules 122 therein. The upper support wall 130 defines a top 134 of the module cavity 132 and the lower support wall 130 defines a bottom 136 of the module cavity 132. Optionally, the sides of the module cavity 132 may be closed. Alternatively, the header housing may include additional support walls along the sides of the module cavity 132. The support walls 130 may include latching features that engage the contact modules 122 to secure the contact modules 122 to the header housing 120.

Each of the contact modules 122 include a plurality of cable assemblies 140 held by a support body 142. Each cable assembly 140 includes a contact sub-assembly 144 terminated to a corresponding cable 102. The contact sub-assembly 144 includes a pair of signal contacts 146 terminated to corresponding signals wires of the cable 102. In alternative embodiments, the contact sub-assembly 144 may include a single signal contact 146 or may include greater than two signal contacts 146. The cable assembly 140 also includes a ground shield 148 providing shielding for the signal contacts 146. In an exemplary embodiment, the ground shield 148 peripherally surrounds the signal contacts 146 along the entire length of the signal contacts 146 to ensure that the signal paths are electrically shielded from interference.

The support body 142 provides support for the contact sub-assembly 144 and the ground shield 148. In an exemplary embodiment, the cables 102 extend into the support body 142 such that the support body 142 supports a portion of the cables 102. The cables 102 extend from the support body 142 at cable exits 150, which, in an exemplary embodiment, are along the top and/or bottom of the support body 142 as opposed to at a rear 151 of the support body 142. The cables 102 transition within the support body 142 from the contact sub-assemblies 144 to the corresponding cable exits 150. The support body 142 controls the positions of the cables 102 and reduces the depth (from front to rear) of the cable header connector 100 as compared to cable header connectors that have cable exits at the rear thereof. The support body 142 organizes the cables 102 by controlling the positions of the cables 102 relative to one another at the cable exits 150. The support body 142 contains the cables 102 forward of the rear 151 of the support body 142.

The support body 142 may provide strain relief for the cables 102. Optionally, the support body 142 may be manufactured from a plastic material. Alternatively, the support body 142 may be at least partially manufactured from a metal material to provide additional shielding for the cables 102 and the cable assemblies 140. For example, the support body 142 may be a metalized plastic material. The support body 142 is sized and shaped to fit into the module cavity 132 and engage the support walls 130 to secure the contact modules 122 to the header housing 120.

Figure 3:
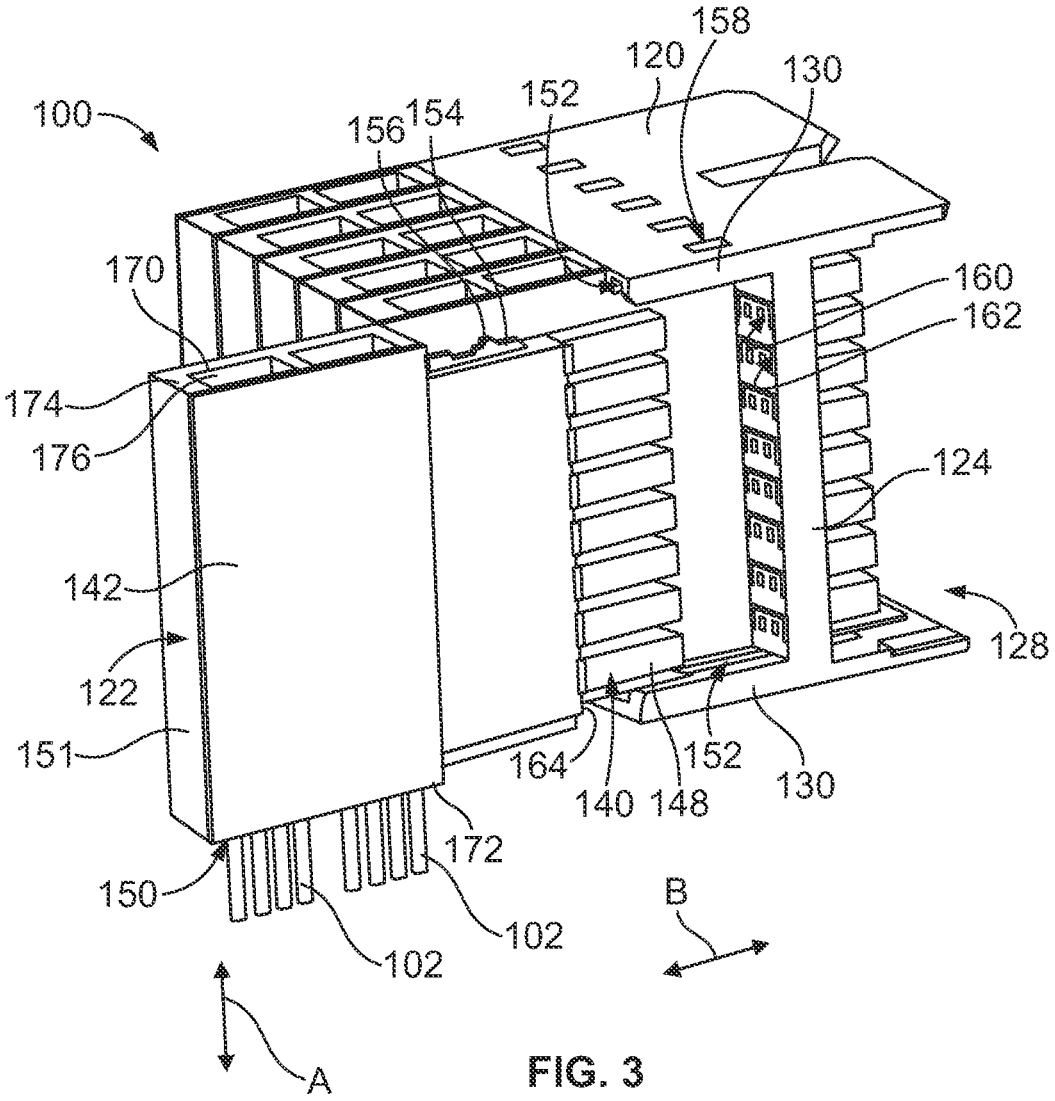
FIG. 3 is a rear perspective view of the cable header connector showing a contact module poised for loading into a header housing of the cable header connector.

FIG. 3 is a rear perspective view of the cable header connector 100 with one of the contact modules 122 outside of the header housing 120 and poised for loading into the header housing 120. The header housing 120 includes guide channels 152 in the support walls 130 to guide the contact module 122 into the header housing 120. The contact modules 122 include guide features 154 at the top and bottom of the support body 142 that are received in the guide channels 152 for guiding the contact module 122 into the header housing 120.

In an exemplary embodiment, the contact module 122 includes a latch 156 that engages a corresponding latch element 158 (e.g. an opening) on the header housing 120 to secure the contact module 122 in the header housing 120. In the illustrated embodiment, the latch 156 on the contact module 122 is an extension extending outward from the guide feature 154, while the latch element 158 on the header housing 120 is an opening that receives the latch 156. Other types of latching features may be used in alternative embodiments to secure the contact module 122 to the header housing 120.

The header housing 120 includes a plurality of signal contact openings 160 through the base wall 124. The header housing 120 includes a plurality of ground shield openings 162 through the base wall 124. When the contact module 122 is coupled to the header housing 120, the signal contacts 146 (shown in FIGS. 1 and 2) are received in corresponding signal contact openings 160 and the ground shields 148 are received in corresponding ground shield openings 162. The signal contact openings 160 and the ground shield openings 162 may include lead-in features, such as chamfered surfaces, that guide the signal contacts 146 and the ground shield 148 into the corresponding openings 160, 162, respectively. Portions of the signal contacts 146 and portions of the ground shields 148 extend forward from a front 164 of the support body 142. Such portions of the signal contacts 146 and the ground shields 148 are loaded through the base wall 124 into the mating cavity 128 for mating with the receptacle connector (not shown). The front 164 of the support body 142 abuts against, or nearly abuts against, the base wall 124 when the contact module 122 is loaded into the header housing 120.

Multiple contact modules 122 are loaded into the header housing 120. The header housing 120 holds the contact modules 122 in parallel such that the cable assemblies 140 are aligned in parallel columns. Any number of contact modules 122 may be held by the header housing 120 depending on the particular application. When the contact modules 122 are stacked in the header housing 120, the cable assemblies 140 may also be aligned in parallel rows.

The support body 142 includes a top 170 and a bottom 172 that engage corresponding support walls 130. In an exemplary embodiment, all of the cables 102 extend from the top 170, from the bottom 172, or from both the top 170 and the bottom 172. The cables 102 extend from cable exits 150 in an exit direction, shown by arrow A, generally perpendicular to the mating direction, shown by arrow B, of the cable header connector 100. None of the cables 102 exit from the back or rear 151 of the support body 142, thereby decreasing the effective length of the cable header connector 100 as compared to cable header connectors that have cable exits 150 at the rear 151. Other components may thus be placed closer to the cable header connector 100, or the cable header connector 100 may be placed closer to a wall or panel in the system, thereby reducing the overall size or depth of the system. Risk of damage to the cables from bending may be reduced by having the cables exit through the top 170 and/or the bottom 172.

In an exemplary embodiment, the support body 142 includes a frame 174 and a cover 176 covering a portion of the frame 174. The frame 174 and the cover 176 hold the cables 102 therebetween. The cover 176 may support the cables 102 at the cable exits 150. Optionally, the cover 176 may be overmolded in place over the frame 174 once the cables 102 are properly positioned. Alternatively, the cover 176 may be pre-manufactured and then coupled to the frame 174 once the cables 102 are properly positioned. The cables 102 may be tightly held by the frame 174 and the cover 176 such that the cables 102 are unable to move within the support body 142, such as for strain relief. For example, the cover 176 may substantially or completely fill the space within the frame 174 around the cables 102. Alternatively, the cables 102 may be loosely held in the support body 142 so as to allow some limited amount of manipulation of the cables 102, such as to move the cables forward or rearward at the cable exits 150. Each cable 102 may have a dedicated cable exit 150, or alternatively, multiple cables 102 may extend from any particular cable exit 150.

Figure 4:
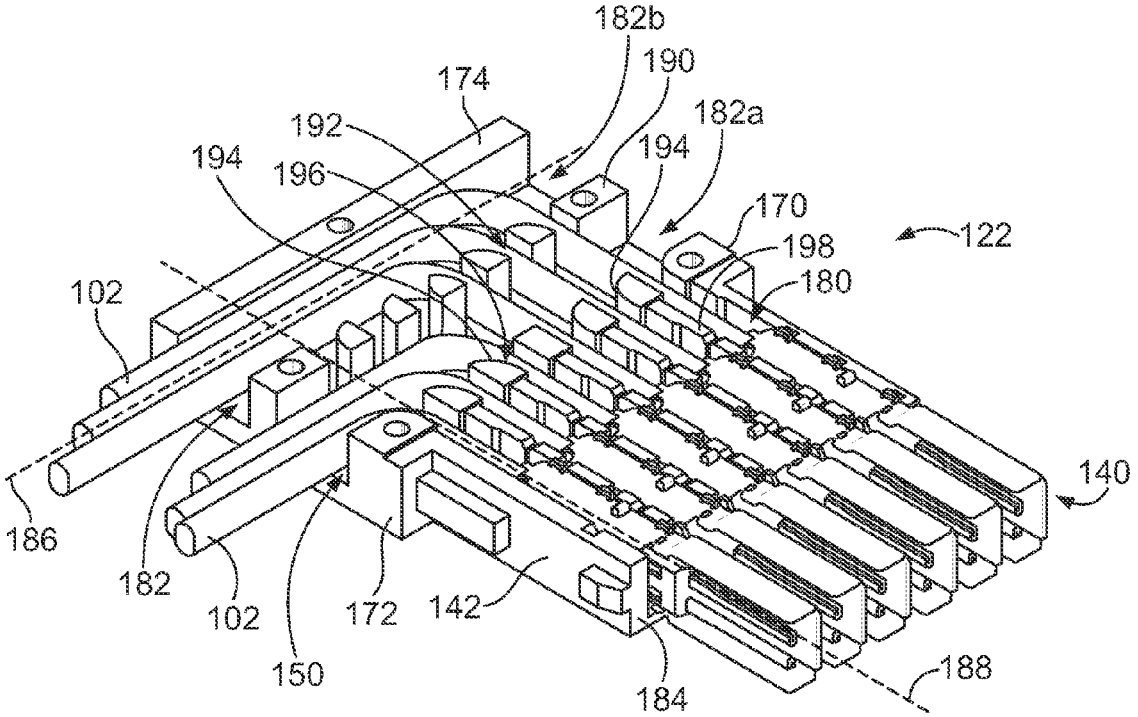
FIG. 4 is a perspective view of a portion of the contact module shown in FIG. 3.

FIG. 4 is a perspective view of a portion of the contact module 122 with the cover 176 (shown in FIG. 3) removed to illustrate the cable assemblies 140 and cables 102 in the frame 174. The frame 174 includes a plurality of contact channels 180 and cable channels 182 open to the contact channels 180. Each contact channel 180 receives a corresponding cable assembly 140 and a portion of the corresponding cable 102. The cable assemblies 140 are axially secured within the contact channels 180 and extend forward of a front 184 of the support body 142.

The cables 102 extend from the contact channels 180 into corresponding cable channels 182. The cables 102 are routed within the cable channels 182 to the top 170 and/or the bottom 172. For example, the cables 102 may be bent within the cable channels 182 from the contact channels 180 toward either the top 170 or the bottom 172. Optionally, the cable channels 182 may extend along cable channel axes 186 that are oriented oblique with respect to contact channel axes 188. Preferably, the cable channel axes 186 are perpendicular to the contact channel axes 188. The cables 102 extend through the contact channels 180 and through the at least one cable channel 182 to an outside of the support body 142. The cables 102 emerging from the support body 102 at corresponding cable exits 150 at respective angles to the contact channel axes 188. Optionally, the cables 102 may emerge in a direction perpendicular to the contact channel axes 188.

In the illustrated embodiment, two cable channels 182 are provided, a front cable channel 182*a* and a rear cable channel 182*b*; however any number of cable channels 182 may be provided, such as one per cable 102. A separating wall 190 is provided between the front and rear cable channels 182. The cables 102 extend directly from the contact channels 180 into the front cable channel 182*a*. The cables 102 pass through the front cable channel 182*a* into the rear cable channel 182*b*. Cable slots 192 are defined in the separating wall 190 between the front cable channel 182*a* and the rear cable channel 182*b*. The cable slots 192 are sized to receive the cables 102. The cable slots 192 may be sized to receive a single cable 102. The cable slots 192 may be aligned with corresponding contact channels 180. The cables 102 in the rear cable channel 182*b* pass through the cable slots 192 and through the front cable channel 182*a* to the corresponding contact channel 180.

In an exemplary embodiment, the support body 142 includes bending anvils 194, such as at the intersection between the front cable channel 182*a* and the contact channels 180 and at the intersection between the rear cable channels 182*b* and the cable slots 192. The bending anvils 194 have bending surfaces 196 that limit or control bending of the cable 102 to ensure that a bend in the cable 102 has a bend radius which is greater than the minimum allowable bend radius of the cable 102. The bending anvils 194 may be provided at ends of separating walls 198 that separate the contact channels 180 from one another. Optionally, the separating walls 198 may have different lengths (for example, extend to different depths within the front cable channel 182*a*) to position the bending anvils 194 at different depths within the front cable channel 182*a*. As such, the cables 102 may be located at different depths within the front cable channel 182*a*. The bending anvils 194 may have bending surfaces 196 on one side thereof, allowing bending in only one direction, such as toward the top 170 or toward the bottom 172. Alternatively, the bending anvils 194 may have bending surfaces 196 on both sides thereof, allowing bending either toward the top 170 or toward the bottom 172. Optionally, the cables 102 may be bent in the free space of the cable channels 182 rather than being bent around bending anvils 194.

In the illustrated embodiment, all of the cables 102 are shown as being bent downward toward the bottom 172 of the support body 142. Three cables 102 are directed toward the bottom 172 in the front cable channel 182*a* and three cables 102 are directed toward the bottom 172 in the rear cable channel 182*b*. The cables 102 are held at the cable exit 150 relative to each other by the frame 174. Optionally, the cable channels 182 may have a width dimension, at least along a portion thereof, which tightly holds the cables 102 to control the position of the cables 102 and limit forward and/or backward movement of the cables 102. Optionally, the cable channels 182 may be oversized and provide clearance between the cables 102 and the walls of the frame 174. Such clearance may be later, at least partially, filled by the cover 176.

Figure 5:
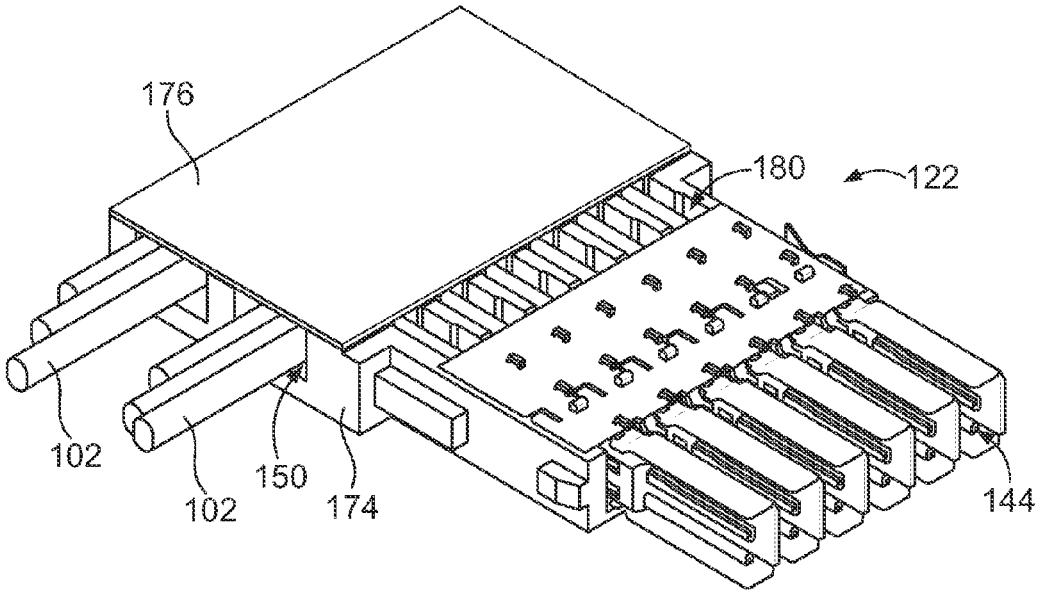
FIG. 5 is a perspective view of the contact module shown in FIG. 3.

FIG. 5 is a perspective view of the contact module 122 with the cover 176 coupled to the frame 174. The cover 176 may be overmolded over the cables 102 after the cables 102 are positioned in the frame 174. For example, plastic material may be injected into the frame 174 around the cables 102 using a low pressure overmolding process so as to not damage the cables 102. Other types of covers, other than an overmolded cover may be used in alternative embodiments, such as a snap-on cover. The cover 176 provides strain relief for the cables 102. The cover 176 holds the cables 102 at the cable exits 150 to control the positions of the cables 102 relative to one another.

Optionally, the cover 176 may be provided over a portion of the frame 174, such as covering the cable channels 182 (FIG. 4) but not covering the contact channels 180 or the contact sub-assemblies 144. Alternatively, the cover 176 may cover at least portions of the contact channels 180 and may cover at least portions of the contact sub-assemblies 144.

Figure 6:
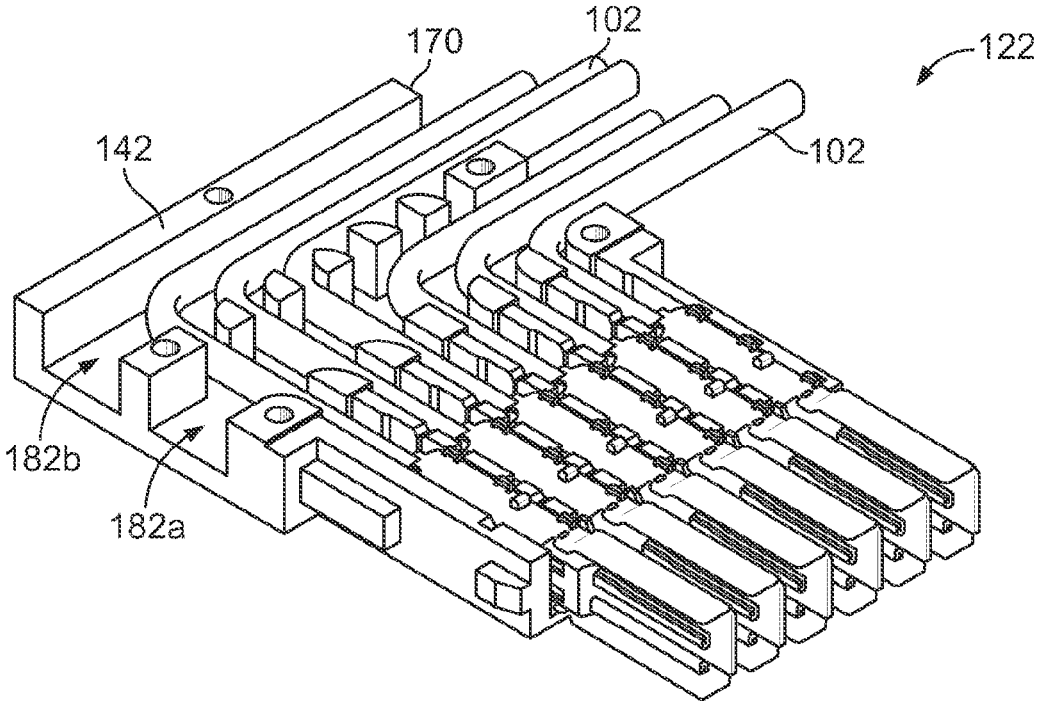
FIG. 6 is a perspective view of a portion of the contact module shown in FIG. 3.

FIG. 6 is a perspective view of a portion of the contact module 122 showing all of the cables 102 bent toward the top 170 of the support body 142. Three cables 102 are directed toward the top 170 in the front cable channel 182*a* and three cables 102 are directed toward the top 170 in the rear cable channel 182*b*.

Figure 7:
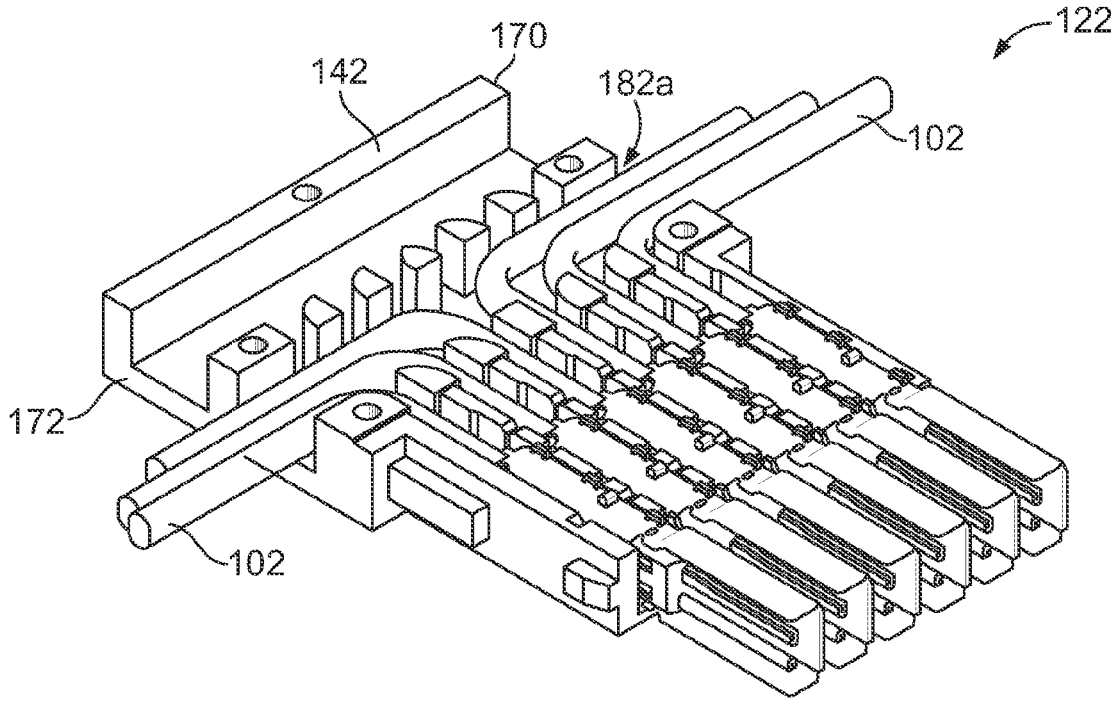
FIG. 7 is a perspective view of a portion of the contact module shown in FIG. 3.

FIG. 7 is a perspective view of a portion of the contact module 122 showing some of the cables 102 bent toward the top 170 of the support body 142 and others of the cables 102 bent toward the bottom 172 of the support body 142. All of the cables 102 are located within the front cable channel 182*a*, with three of the cables 102 directed toward the bottom 172 and three cables 102 directed toward the top 170.

Figure 8:
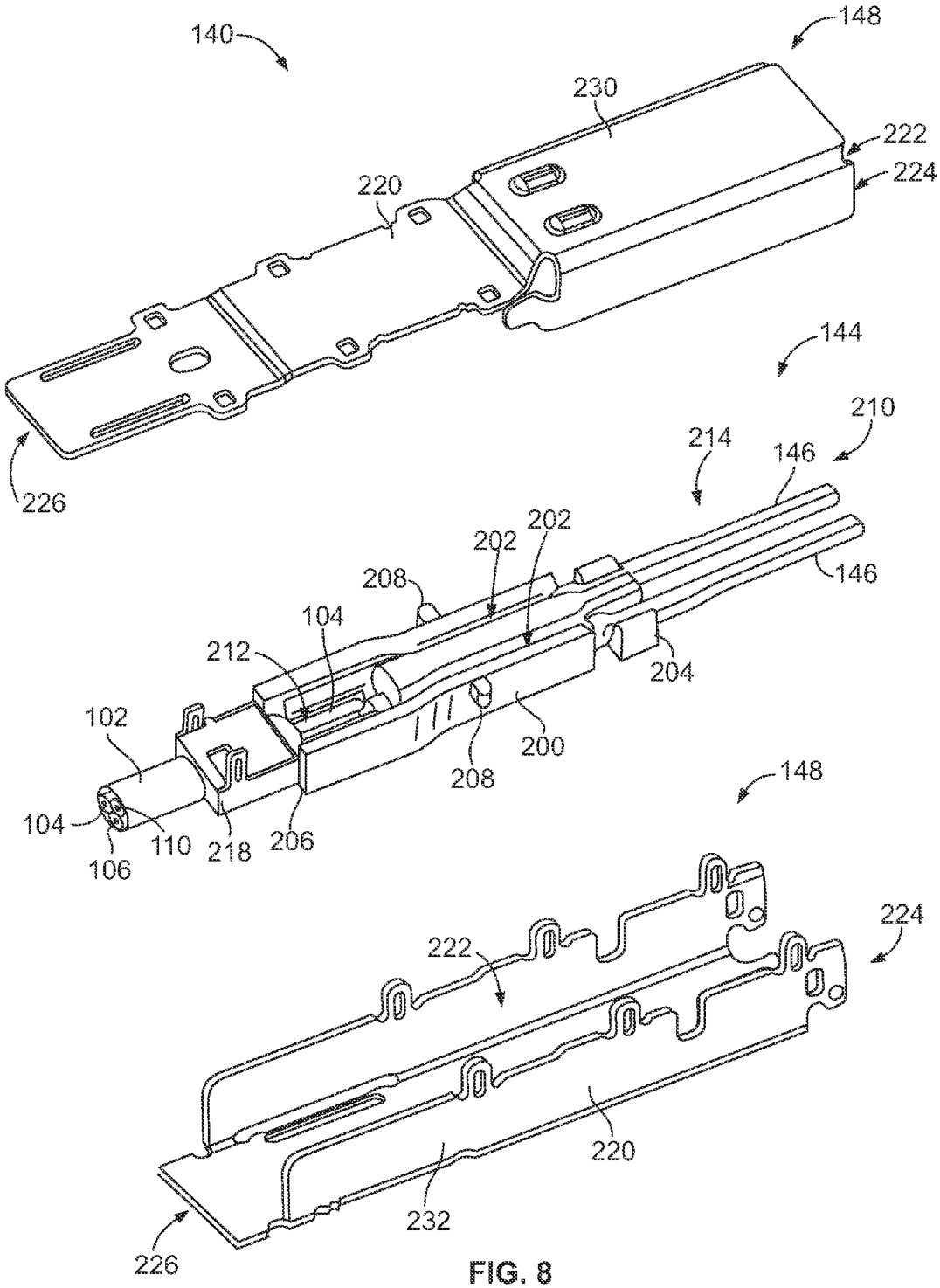
FIG. 8 is an exploded view of a cable assembly of the contact module.

FIG. 8 is an exploded view of one of the cable assemblies 140 illustrating the ground shield 148 poised for coupling to the contact sub-assembly 144. FIG. 8 illustrates an exemplary embodiment of the cable 102 showing two signal wires 104, 106 and a drain wire 110 within the jacket of the cable 102. Other types of cables may be provided in alternative embodiments.

The contact sub-assembly 144 includes a mounting block 200 that holds the signal contacts 146. The mounting block 200 is positioned forward of the cable 102. The signal wires 104, 106 extend into the mounting block 200 for termination to the signal contacts 146. The mounting block 200 includes contact channels 202 that receive corresponding signal contacts 146 therein. The contact channels 202 are generally open at a top of the mounting block 200 to receive the signal contacts 146 therein, but may have other configurations in alternative embodiments. The mounting block 200 includes features to secure the signal contacts 146 in the contact channels 202. For example, the signal contacts 146 may be held by an interference fit in the contact channels 202.

The mounting block 200 extends between a front 204 and a rear 206. In an exemplary embodiment, the signal contacts 146 extend forward from the mounting block 200 beyond the front 204. The mounting block 200 includes locating posts 208 extending from opposite sides of the mounting block 200. The locating posts 208 are configured to position the mounting block 200 with respect to the ground shield 148 and/or the support body 142 (shown in FIG. 3).

The signal contacts 146 extend between mating ends 210 and terminating ends 212. The signal contacts 146 are terminated to corresponding signal wires 104, 106 of the cable 102 at the terminating ends 212. For example, the terminating ends 212 may be welded, such as by resistance welding or ultrasonic welding, to exposed portions of the conductors of the signal wires 104, 106. Alternatively, the terminating ends 212 may be terminated by other means or processes, such as by soldering the terminating ends 212 to the signal wires 104, 106, by using insulation displacement contacts, or by other means. The signal contacts 146 may be stamped and formed or may be manufactured by other processes.

In an exemplary embodiment, the signal contacts 146 have pins 214 at the mating ends 210. The pins 214 extend forward from the front 204 of the mounting block 200. The pins 214 are configured to be mated with corresponding receptacle contacts (not shown) of the receptacle connector (not shown).

The ground shield 148 has a plurality of walls 220 that define a receptacle 222 that receives the contact sub-assembly 144. The ground shield 148 extends between a mating end 224 and a terminating end 226. The mating end 224 is configured to be mated with the receptacle connector. The terminating end 226 is configured to be electrically connected to a ground ferrule 218 and/or the cable 102. The mating end 224 of the ground shield 148 is positioned either at or beyond the mating ends 210 of the signal contacts 146 when the cable assembly 140 is assembled. The terminating end 226 of the ground shield 148 is positioned either at or beyond the terminating ends 212 of the signal contacts 146. The ground shield 148 provides shielding along the entire length of the signal contacts 146. The ground shield 148, when coupled to the contact sub-assembly 144, peripherally surrounds the signal contacts 146. In an exemplary embodiment, the ground shield 148 extends along at least a portion of the cable 102 such that the ground shield 148 peripherally surrounds at least part of the cable braids of the signal wires 104, 106 and/or cable 102, ensuring that all sections of the signal wires 104, 106 are shielded.

The ground shield 148 includes an upper shield 230 and a lower shield 232. The receptacle 222 is defined between the upper and lower shields 230, 232. The contact sub-assembly 144 is positioned between the upper shield 230 and the lower shield 232.

Figure 9:
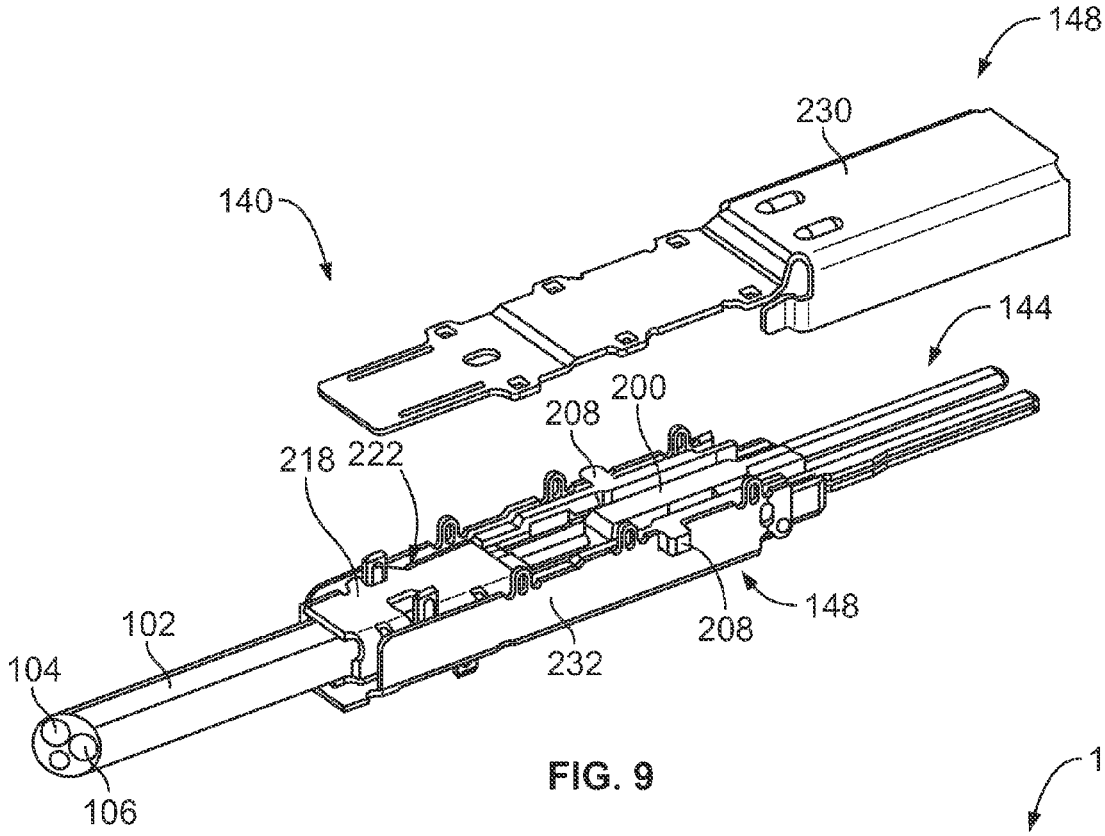
FIG. 9 is a partially assembled view of the cable assembly.
Figure 10:
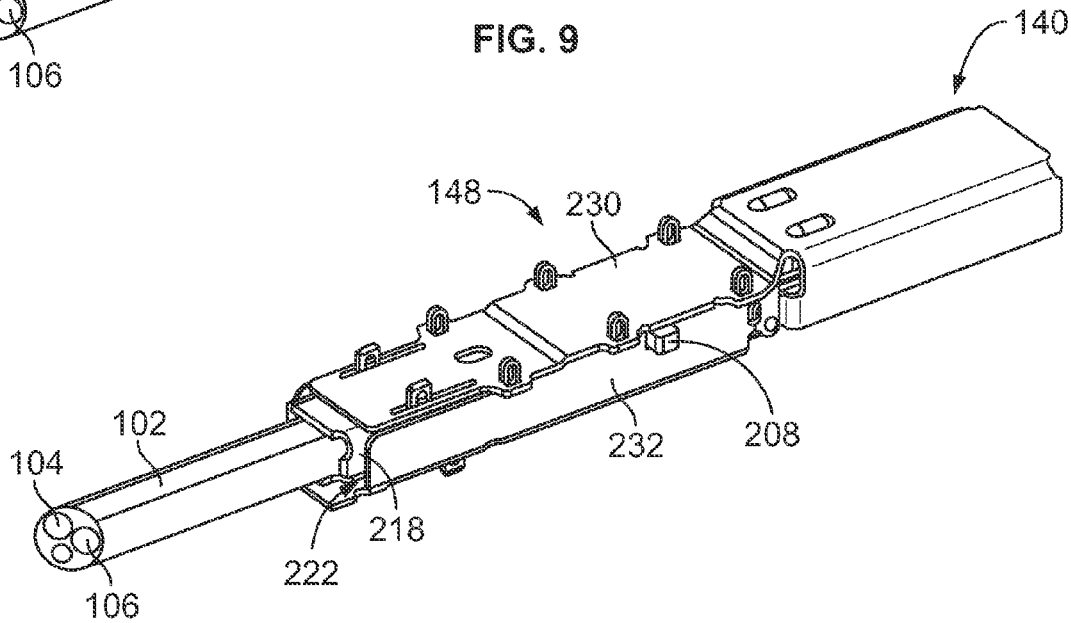
FIG. 10 is a top perspective view of the cable assembly.
Figure 11:
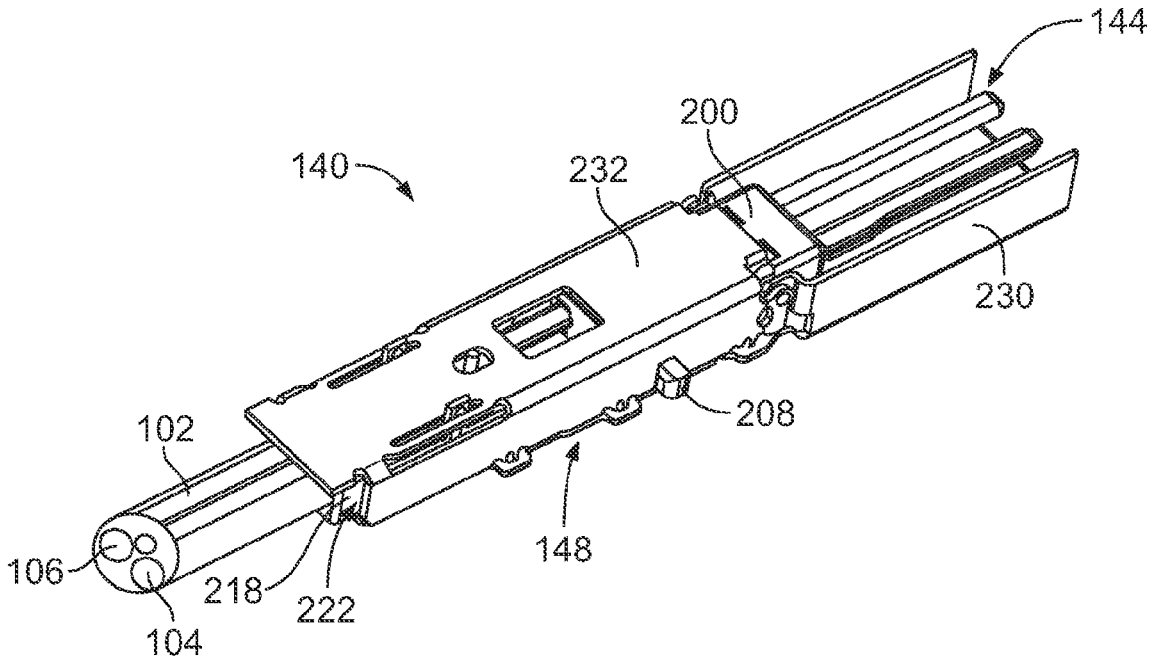
FIG. 11 is a bottom perspective view of the cable assembly.

FIG. 9 is a top perspective view of the cable assembly 140 showing the contact sub-assembly 144 loaded into the lower shield 232 with the upper shield 230 poised for mounting to the lower shield 232. FIG. 10 is a top perspective view of the cable assembly 140 showing the upper shield 230 coupled to the lower shield 232. FIG. 11 is a bottom perspective view of the cable assembly 140.

When the contact sub-assembly 144 is loaded into the receptacle 222, the mounting block 200 is positioned within the lower shield 232. The locating posts 208 secure the axial position of the contact sub-assembly 144 with respect to the ground shield 148. The ground ferrule 218 and a portion of the cable 102 are also received in the receptacle 222. The ground shield 148 provides peripheral shielding around the ground ferrule 218 and the cable 102. The ground ferrule 218 may be positioned immediately behind, and may engage, the mounting block 200 to provide strain relief for the cable 102 and/or the signal wires 104, 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable header connector comprising:

a contact module having a support body and a plurality of cable assemblies held by the support body and arranged in a column;

the cable assemblies each comprising a contact terminated to a cable and a ground shield coupled to and providing electrical shielding for the contact;

the support body having a frame defining contact channels extending along respective contact channel axes which are parallel to each other, and the frame defining cable channels extending along respective cable channel axes intersecting the contact channels at an angle, the contact channel axes extending generally from a front to a rear of the support body and the cable channel axes cable channels extending generally parallel to each other from one side to another side of the support body, wherein the cables extend through the frame within the contact channels and through the at least one cable channel to an outside of the support body, the cables emerging from the support body at corresponding cable exits defined at least one of the sides of the support body at respective angles to the contact channel axes, the support body including a cover overmolded in situ to the frame in the cable channels over the cables.

2. The cable header connector of claim 1, wherein each contact extends parallel to the contact channel axes, the cables emerging from the support body at the cable exits in an exit direction being generally perpendicular to the contact channel axes.

3. The cable header connector of claim 1, wherein the cables are bent in the at least one cable channel between the corresponding cable exits and the contact channels.

4. The cable header connector of claim 1, wherein the support body includes bending anvils, the cables being bent along the bending anvils to control a bend radius of the cables in the at least one cable channel.

5. The cable header connector of claim 1, wherein the support body includes separating walls between and separating the contact channels, the support body including bending anvils at ends of the supporting walls at the intersections of the contact channels and the at least one cable channel.

6. The cable header connector of claim 1, wherein the sides of the support body define a top and a bottom, the contact sub-assemblies extending from the front of the support body, the cables emerging from the support body at the corresponding cable exits at least at one of the top and the bottom.

7. The cable header connector of claim 1, wherein the cables are contained forward of the rear of the support body.

8. The cable header connector of claim 1, wherein the at least one cable channel comprises a front cable channel and a rear cable channel, at least some of the cables being routed to the corresponding cable exits associated with the front cable channel and at least some of the cables being routed to the corresponding cable exits associated with the rear cable channel.

9. The cable header connector of claim 8, wherein the support body includes a separating wall between the front cable channel and the rear cable channel, the separating wall having cable slots, the cables in the rear cable channel passing through the cable slots and through the front cable channel to the corresponding contact channels.

10. The cable header connector of claim 1, wherein the cover supports the cables within the at least one cable channel.

11. A cable header connector comprising:

a header housing having a base wall with support walls extending rearward from the base wall to define a module cavity behind the base wall, the support walls being arranged along a top and a bottom of the module cavity; and contact modules received in the module cavity, each contact module having a support body and a plurality of cable assemblies held by the support body and arranged in a column;

the cable assemblies each having a contact terminated to a cable and a ground shield coupled to and providing electrical shielding for the contact sub-assembly;

the support body having a top and a bottom opposite the top, the top extending along the support wall at the top of the module cavity, the bottom extending along the support wall at the bottom of the module cavity;

the support body having a frame defining contact channels extending along contact channel axes, the contact channels extending generally front to rear within the support body, the contact channels receiving portions of the contacts and portions of the cables;

the support body having the frame defining a front cable channel and a rear cable channel having cable exits associated therewith and having a separating wall between the front cable channel and the rear cable channel, the cable channels extending generally side to side within the support body, the front and rear cable channels receiving further portions of the cables extending from the contact channels with at least some of the cables being routed to the cable exits associated with the front cable channel and at least some of the cables being routed to the cable exits associated with the rear cable channel, the separating wall having cable slots, the cables being routed in the frame through the rear cable channel from the cable exits at least at one of the top and the bottom of the support body through the cable slots and through the front cable channel to the corresponding contact channels.

12. The cable header connector of claim 11, wherein the cables are bent in the corresponding cable channel between the cable exits and the contact channels.

13. The cable header connector of claim 11, wherein the support body includes bending anvils, the cables being bent along the bending anvils to control a bend radius of the cables in the corresponding cable channel.

14. The cable header connector of claim 11, wherein the support body includes separating walls between and separating the contact channels, the support body including bending anvils at ends of the separating walls at respective intersections of the contact channels and the cable channels.

15. The cable header connector of claim 11, wherein the support body includes a rear opposite the header housing, the cables contained forward of the rear of the support body.

16. The cable header connector of claim 11, wherein the support body includes a frame defining the contact channels and the cable channels, the support body including a cover coupled to the frame to cover the at least one cable channel.

* * * * *